US009474350B2

(12) United States Patent
Thompson

(10) Patent No.: US 9,474,350 B2
(45) Date of Patent: Oct. 25, 2016

(54) RETRACTABLE COSMETIC PENCIL

(71) Applicant: International Cosmetic Suppliers Ltd. (Taiwan Branch), Taipei (TW)

(72) Inventor: David Thompson, Taipei (TW)

(73) Assignee: INTERNATIONAL COSMETIC SUPPLIERS LTD, Taipei (TW)

( * ) Notice: Subject to any disclaimer, the term of this patent is extended or adjusted under 35 U.S.C. 154(b) by 174 days.

(21) Appl. No.: 14/489,297

(22) Filed: Sep. 17, 2014

(65) Prior Publication Data

US 2016/0073765 A1 Mar. 17, 2016

(51) Int. Cl.
*A45D 40/20* (2006.01)
*A45D 40/04* (2006.01)

(52) U.S. Cl.
CPC ..... *A45D 40/205* (2013.01); *A45D 40/04* (2013.01); *A45D 2040/208* (2013.01)

(58) Field of Classification Search
CPC combination set(s) only.
See application file for complete search history.

(56) References Cited

U.S. PATENT DOCUMENTS 2,559,906 A * 7/1951 Tursky ..... A45D 40/023 401/107
4,664,288 A * 5/1987 Pereira ..... B65D 51/1688 215/207
5,451,113 A * 9/1995 Lund ..... A45D 40/06 206/385
5,984,554 A * 11/1999 Bouix ..... A45C 13/008 206/385
6,200,047 B1 * 3/2001 Holloway ..... A45D 40/04 401/68
6,227,739 B1 * 5/2001 Kageyama ..... B43K 5/06 401/172
8,453,866 B2 * 6/2013 Kamath ..... B65D 1/0246 215/329

OTHER PUBLICATIONS

Clinique, Chubby Stick Intense Moisturizing Lip Color Balm; http://www.sephora.com/chubby-stick-intense-moisturizing-lip-colour-balm; retrieved Sep. 17, 2014.

* cited by examiner

*Primary Examiner* — David Walczak
(74) *Attorney, Agent, or Firm* — Polsinelli PC

(57) ABSTRACT

Retractable cosmetic pencil including a barrel, godet, lower threaded portion and end cap. The godet can be configured to move longitudinally within the barrel. The lower threaded portion can be configured to be coupled to the godet. The end cap can be configured to be coupled to the lower threaded portion. An injection receiving opening can formed be in the closed end of the end cap, wherein the injection receiving opening is configured to receive an injection nozzle such that the retractable cosmetic pencil can be backfilled. The godet can have an injection receiving portion in its outermost end configured to receive product. The pencil can include an outer cap comprising a sleeve which is configured to provide a seal so as to prevent passage of air through an inner portion of the outer cap when the outer cap receives an upper portion of the pencil therein.

14 Claims, 10 Drawing Sheets

RETRACTABLE COSMETIC PENCIL

FIELD OF DISCLOSURE

The present disclosure relates to a retractable cosmetic pencil.

BRIEF DESCRIPTION OF THE DRAWINGS

Embodiments of the present application will now be described, by way of example only, with reference to the attached Figures, wherein.

DETAILED DESCRIPTION

Figure 1:
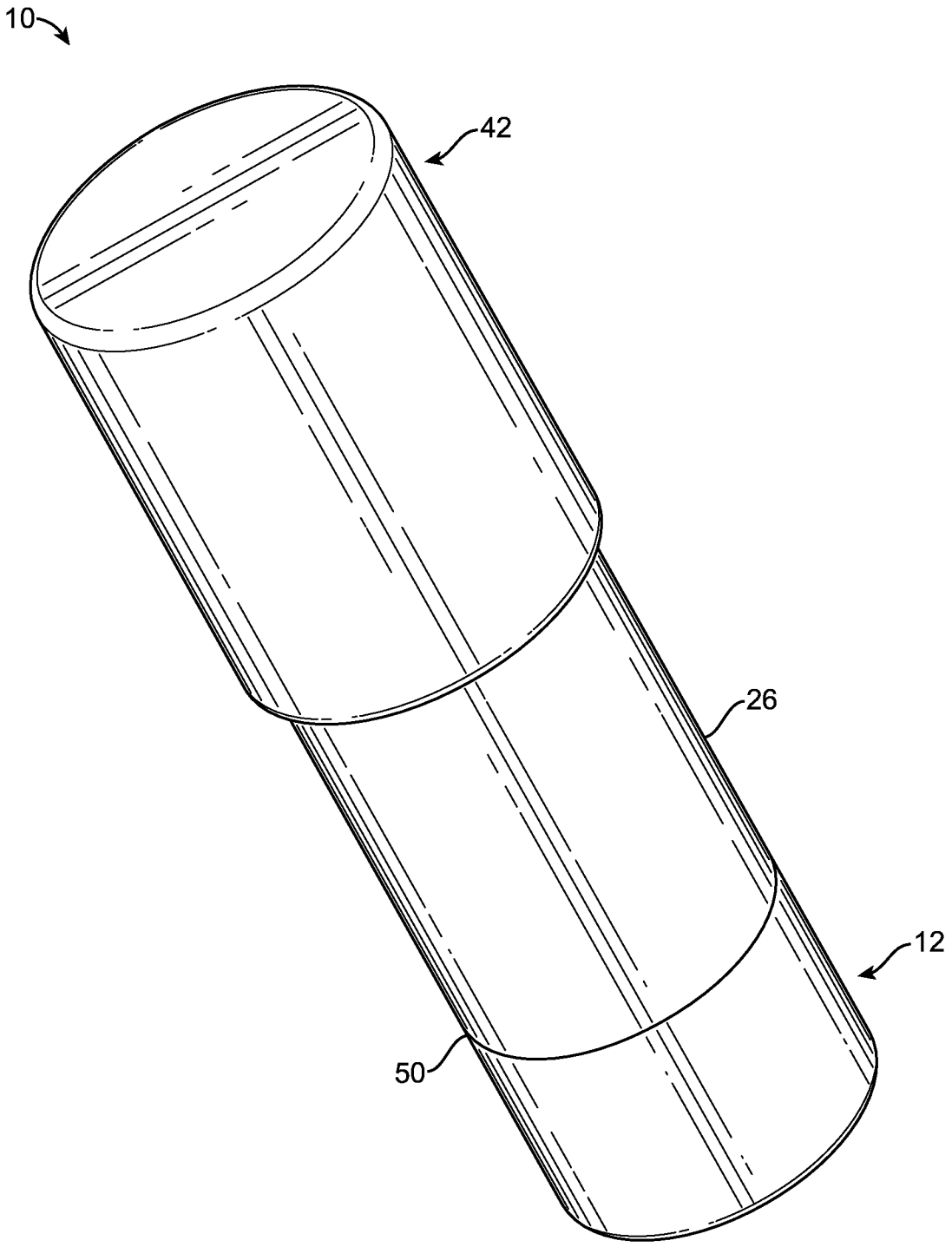
FIG. 1 illustrates an isometric view of an exemplary retractable pencil according to the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood that the embodiments described herein can be practiced without these specific details. In other instances, methods, procedures and components have not been described in detail so as not to obscure the related relevant feature being described. The drawings are not necessarily to scale and the proportions of certain parts have been exaggerated to better illustrate details and features of the present disclosure. Also, the description is not to be considered as limiting the scope of the embodiments described herein.

The present disclosure concerns a retractable cosmetic pencil that can be backfilled or front filled. The assembly of the retractable pencil prevents air from entering the area that holds the cosmetic product or formula. Specifically, an exposed end of is covered by an end cap that has a seal formed therein. In at least one embodiment two O-rings are provided on each side of a joint between the end cap and the barrel, thereby preventing or minimizing the amount of air that comes into contact with the product when the product is within the assembled retractable pencil. Additionally, this assembled configuration allows for backfilling or front filling of a product, such as for example lipstick. An opening can be provided in the end cap for backfilling. After backfilling is complete, the end cap can be sealed by a plug or other sealing device thereby providing a fit that it is substantially air-tight. The retractable has a godet, which is configured to receive and hold the product. A lower portion of the godet can have a hole defined therein in, through which product may be introduced during backfilling. In at least one embodiment, the godet is designed such that it is substantially the same diameter of the inner diameter of the body of the retractable cosmetic pencil. In at least one embodiment, the godet has a side wall portion that slides relative to the barrel. In at least one embodiment the lower portion of the godet can have an indenture, rather than an opening, which can be useful during manufacture. In at least one embodiment, in order to enable backfilling a barrel, godet and activation member can be provided as an assembled unit with an O-ring creating a seal between the barrel and the activation member. In at least one embodiment, an O-ring can be assembled to the activation member and an end cap can be supplied separately. In at least one embodiment, after backfilling the end cap can be separately assembled by, thereby creating an air-tight seal between the activation member and the end cap with O-ring.

The present disclosure also concerns an outer cap for a cosmetic pencil. The outer cap can be used to cover the dispensing end of the pencil when not in use, thereby protecting the dispensable carried by the pencil. The outer cap can include a soft sealing sleeve located inside outer cap. The outer cap can be composed of a hard material, such as hard plastic. The sealing sleeve can also include venting grooves which can allow air from inside the cap to escape as the outer cap is connected to the rest of the pencil, thereby providing for a better seal between the outer cap and the remainder of the pencil. To the extent that venting grooves prevent air from being trapped in the outer cap, they prevent pressure from being built up in the outer cap, thus decreasing the likelihood that the outer cap will pop off of the pencil than would be the case if the vents were not present.

The presence of the soft inner seal can allow the outer cap to be of the same hard material as the body of the pencil, obviating the need to construct the entire end cap of a softer material. The configurations described herein can thus allow the out cap to be consistent with the pencil, look better, and be resistant to scratching, while providing an airtight seal via the inner sleeve.

FIG. 1 illustrates an isometric view of an exemplary retractable pencil 10 according to the present disclosure. As illustrated, the retractable cosmetic pencil 10 can include an outer cap 42, a barrel 26, and an end cap 12. The end cap 12 and the barrel 26 can slidingly meet at perimeter 50. In at least one configuration, the end cap 12 can be configured to be rotatable relative to the barrel 26 so that a cosmetic material therein (not shown) can be moved longitudinally relative to the barrel 26 in response to rotation of the end cap 12. The rotation of the end cap 12 to move the cosmetic is an example of an advancement mechanism and other mechanisms for advancement of the cosmetic are considered within the scope of this disclosure. In at least one embodiment, the end cap 12 can have one or more sealable openings to enable backfilling of a product 46.

Figure 2:
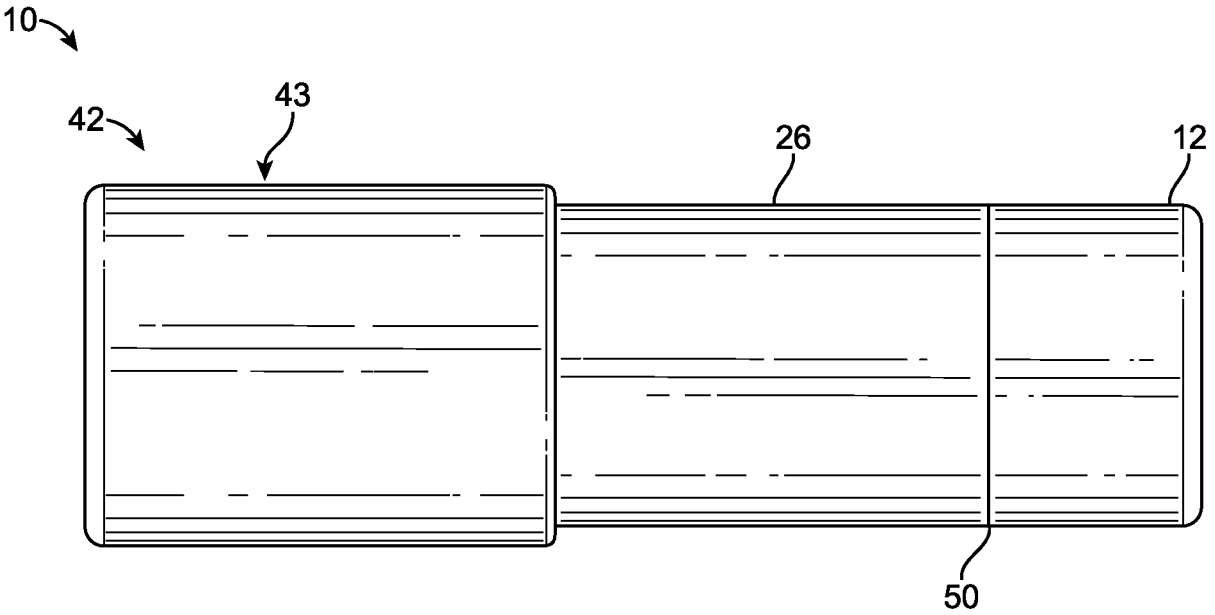
FIG. 2 illustrates a side elevational view of the exemplary retractable pencil of FIG. 1.

FIG. 2 illustrates a side elevational view of the exemplary retractable pencil 10 of FIG. 1. As shown in FIG. 2, the retractable cosmetic pencil 10 can include an outer cap 42, a barrel 26, and an end cap 12. Again, the end cap 12 and the barrel 26 are shown meeting at perimeter 50. The outer cap 42 can have a longitudinal wall 43. In at least one embodiment the end cap can house a sleeve 44 (not visible) to prevent contamination of a product 46 (not visible) stored within the pencil 10. The outer cap 42 as illustrated is substantially cylindrical in shape. However, in other embodiments, the outer cap 42 can have other shapes such as conical, curvilinear, spherical (for example a hemispherical shape) or other non-cylindrical shape. In other embodiments, the outer cap 42 can be omitted and a seal to initially protect or cover the product 46 can be provided. The seal can be a disposable cover or other device that keeps the product clean.

Figure 3:
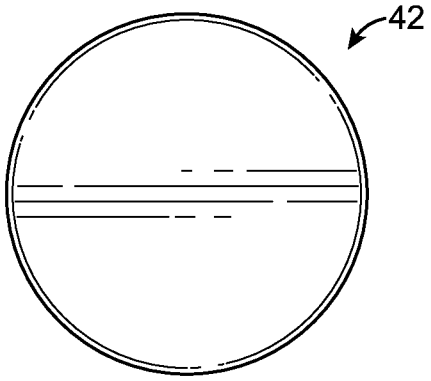
FIG. 3 illustrates a top plan view of the exemplary retractable pencil of FIG. 1.

FIG. 3 illustrates a top plan view of the exemplary retractable pencil 10 of FIG. 1. The top of the outer cap 42 illustrated is substantially circular. However, other shapes are possible within this disclosure, such as square or triangular.

Figure 4:
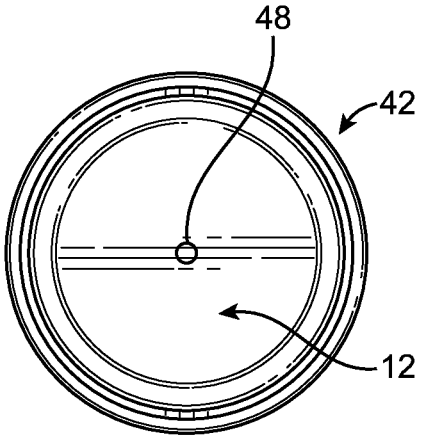
FIG. 4 illustrates a bottom plan view of the exemplary retractable pencil of FIG. 1.

FIG. 4 illustrates a bottom plan view of the exemplary retractable pencil 10 of FIG. 1. As shown, the end cap 12 can have a hole therein to enable backfilling of product 46. In at least one embodiment, the end cap 12 can include an indentation 48 which can be used as a tool receiving landing during manufacture of the pencil 10. Also shown, the outer cap 42 can be wider than the remainder of the pencil 10 (see FIGS. 1-2). The bottom of the end cap 12 illustrated is substantially circular. However, other shapes are possible within this disclosure, such as square or triangular. Additionally the bottom of the end cap 12 can be broader that the remainder of the pencil 10, so as to enable the pencil 10 to rest vertically on a flat surface.

Figure 5:
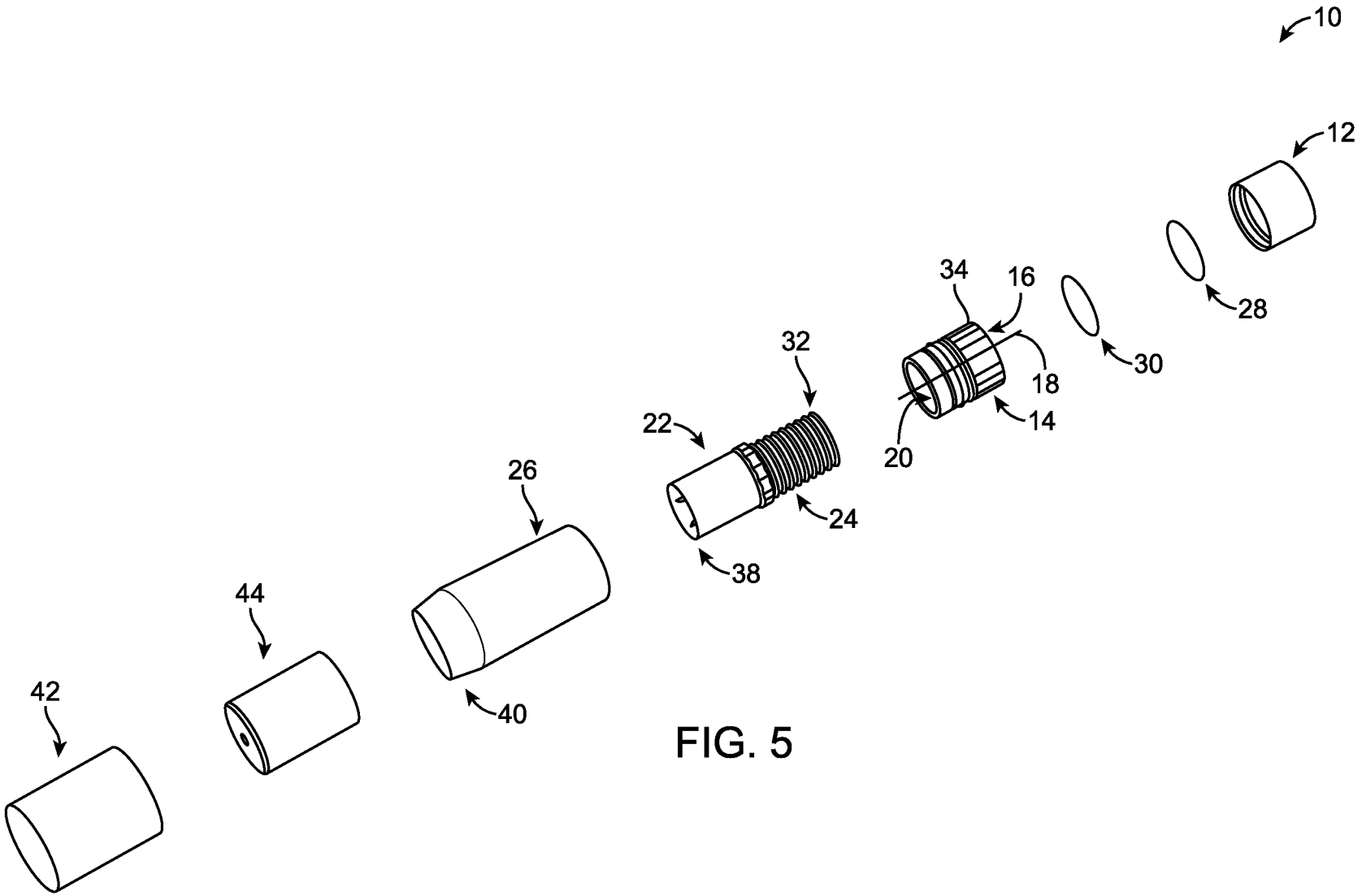
FIG. 5 illustrates an exploded view of the exemplary retractable pencil of FIG. 1.

FIG. 5 illustrates an exploded view of the exemplary retractable pencil 10 of FIG. 1. As shown, the retractable pencil 10 can include an end cap 12 and an activation member 14 coupled to the end cap 12. The activation member 14 can be rotatable by the end cap 12 to urge a portion of a product 46 (not shown) such as a lipstick out of the barrel 26. The activation member can form a through-hole 16 substantially along an axis 18 of the activation member 14. The through-hole 16 can have an inside portion 20 that is at least partially threaded. As shown, the pencil can include a godet 22 which can be used to hold a product 46 (not shown) for dispensing. In at least one embodiment, the godet 22 can have an exterior 24 that is at least partially threaded and is configured to be coupled to the at least partially threaded inside of the activation member 14. As discussed in reference to FIGS. 1-2, the pencil 10 can include a barrel 26. The barrel 26 can act as a sleeve around the godet 22 and the activation member 14. In at least one embodiment, the barrel 26 can be coupled to the activation member 14. The pencil 10 can further include one or more O-rings to enable a substantially air tight fit of pencil 10 components. FIG. 5 shows a first O-ring 28 which can be configured to be coupled to the activation member 14 and abutted to the end cap 12, thereby providing a seal between the end cap 12 and the activation member 14. In at least one embodiment, a second O-ring 30 can be configured to be coupled to the activation member 14 and can be configured to abut the barrel 26, thereby providing a seal between the barrel 26 and the activation member 14. The godet 22 can have an opening formed in its bottom. In at least one embodiment, the activation member 14 and godet 22 can be assembled together and respectively configured to receive a product 46 through an open end (32, 34) formed in both of the godet 22 and the activation member 14, thereby enabling back filling of product 46. In at least one embodiment, the retractable pencil 10, can comprise an outer cap 42 configured to be releasably coupled to the barrel 26. The pencil 10 can also include a sealing member 44 located within the outer cap 42. The sealing member 44 can be configured to provide a seal with the barrel 26 so as to prevent free exchange of air when the outer cap 42 is coupled to the barrel 26.

In at least one embodiment, the godet 22 can include an opening formed in an open end 32 closest to the end of the activation member 14 that is received in the end cap 12. This configuration can facilitate backfilling, as discussed herein. In at least one embodiment, the activation member 14 and the godet 22 can be assembled together.

Figure 6:
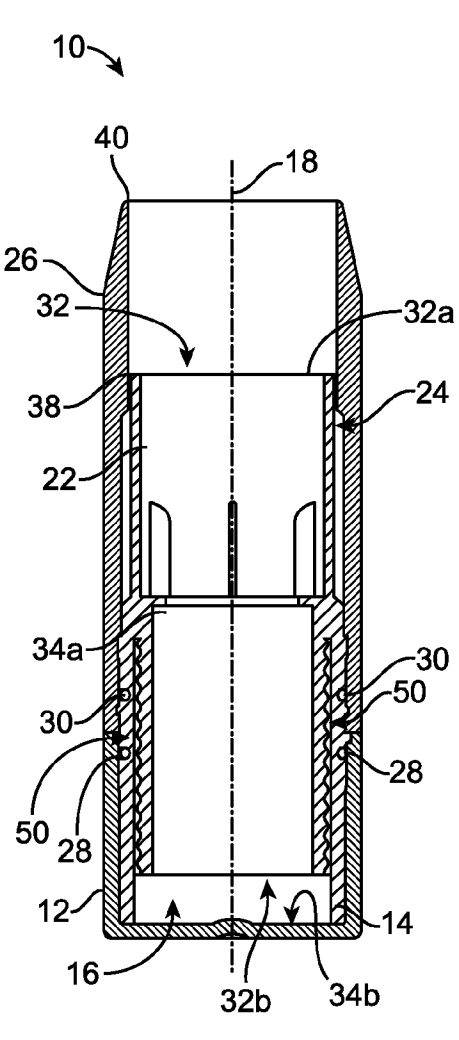
FIG. 6 illustrates a detailed cross-sectional view of an exemplary retractable pencil in a retracted configuration.

In at least one embodiment, the end cap 12 can have only a single opening formed in one end 32*b* (see FIG. 6). The single opening can be configured to receive the activation member 14, thereby providing an effective sealing of the product from the bottom.

FIG. 6 illustrates a detailed cross-sectional view of an exemplary retractable pencil 10 in a retracted configuration. As shown, the barrel 26 can have an outermost end 40 from which product 46 (not shown) can protrude and be urged outwardly by the godet 22. The outermost end 38 of the godet 22 can be urged toward the outermost end 40 of the barrel 26 by the action of the activation member 14. The activation member 14 has an axis 18 running through it, (see also FIG. 5). The activation member 14 has open ends (34*a*, 34*b*). The godet 22 also has open ends (32*a*, 32*b*). Openings 32 and 34 can facilitate backfilling of the pencil 10 with product 46. O-rings 28 and 30 can prevent air from entering the pencil 14 between the barrel 26 and the end cap 12 where the barrel 26 and end cap 12 meet. In at least one embodiment, the godet 22 has a through-hole formed therein to match the activation member through-hole 16. The godet 22 exterior 24 can reside within the barrel 26, with the barrel 26 forming a sheath around the godet 22, as shown.

Figure 7:
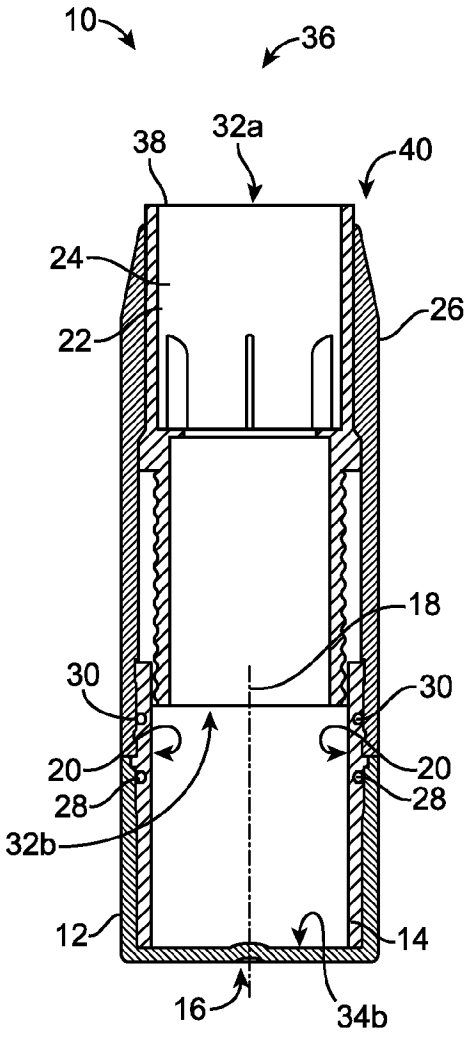
FIG. 7 illustrates a detailed cross-sectional view of an exemplary retractable pencil in an expanded configuration.

FIG. 7 illustrates a detailed cross-sectional view of an exemplary retractable pencil 10 in an expanded configuration 36. In at least one embodiment, the pencil 10 can be configured to have an extended orientation 36 in which the godet 22 is wound outward so that it has an outermost end 38 that is substantially flush with an outer most end 40 of the barrel 26. An opening 32*a* in the godet 22 can be configured to receive a product therethough. An exterior surface 24 of the godet 22 can slide within the barrel 26. As discussed above, the godet 22 can have a through-hole formed inside of the godet 22. In the embodiment shown, the activation member 14 has been rotated to urge the godet 22 upward.

Figure 8:
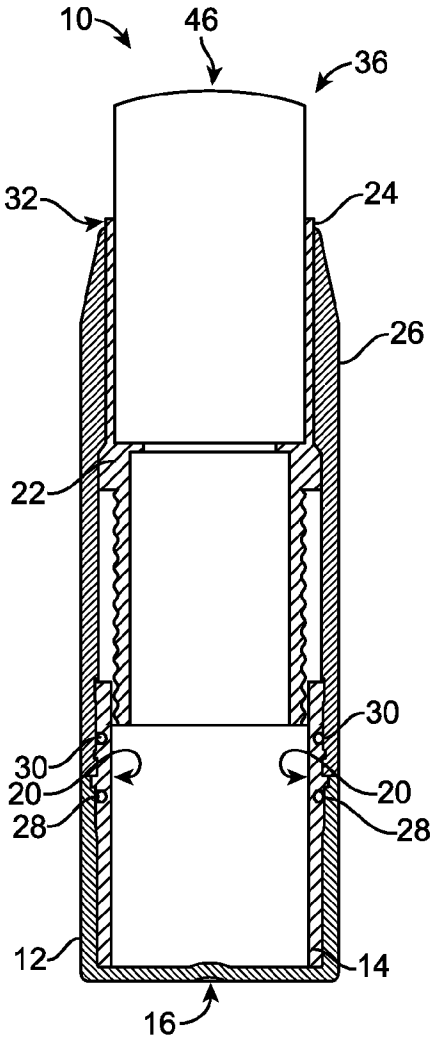
FIG. 8 illustrates a detailed cross-sectional view of an exemplary retractable pencil in an expanded configuration in which a cosmetic is present for dispensing.

FIG. 8 is similar to FIG. 7 except that FIG. 8 in an expanded configuration 36 of the pencil 10 in which a product 46 is shown protruding from an open end 32 of the godet 22. The outer cap 42 has been removed. As illustrated the product 46 is exposed when the outer cap 42 is removed. When the product 46 is exposed it can be applied to the desired person or object. When the exposed product 46 is less than a desired amount, the present disclosure allows for additional product 46 to be exposed by rotating the end cap 12. As illustrated the exposed product 46 is substantially conical.

Figure 9:
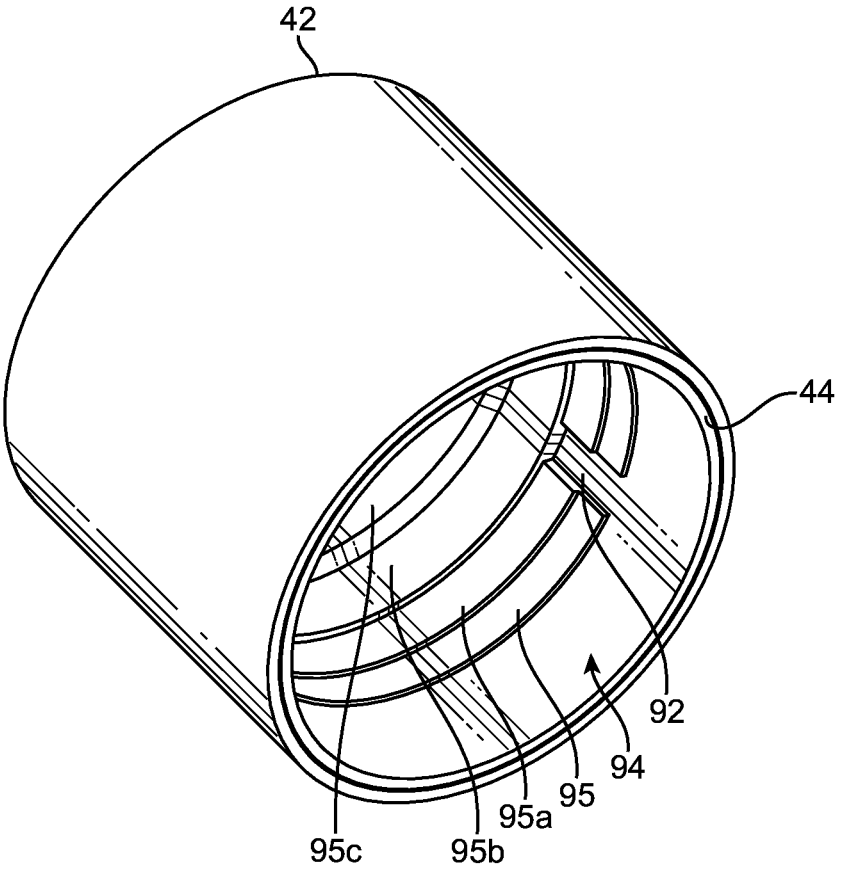
FIG. 9 illustrates a detailed view of an exemplary end cap of a retractable pencil.

FIG. 9 illustrates a detailed view of the outer cap 42 and its sleeve 44. As shown, the inner portion 95 of sleeve 44 can include tapering elements 95-95*c*. Tapering elements 95-95*c* can collectively act as a baffle to prevent product 46 from communicating with ambient air when the outer cap 42 is coupled to the barrel 26. The sleeve 44 can also include one or more troughs 92 which can allow air to escape from the outer cap 42 during coupling with the barrel. As shown in FIG. 9, a trough can be formed in one or more of the tapering elements (95*a*, 95*b*, for example). Sleeve 44 can be composed of flexible plastic or other suitable material.

Figure 10:
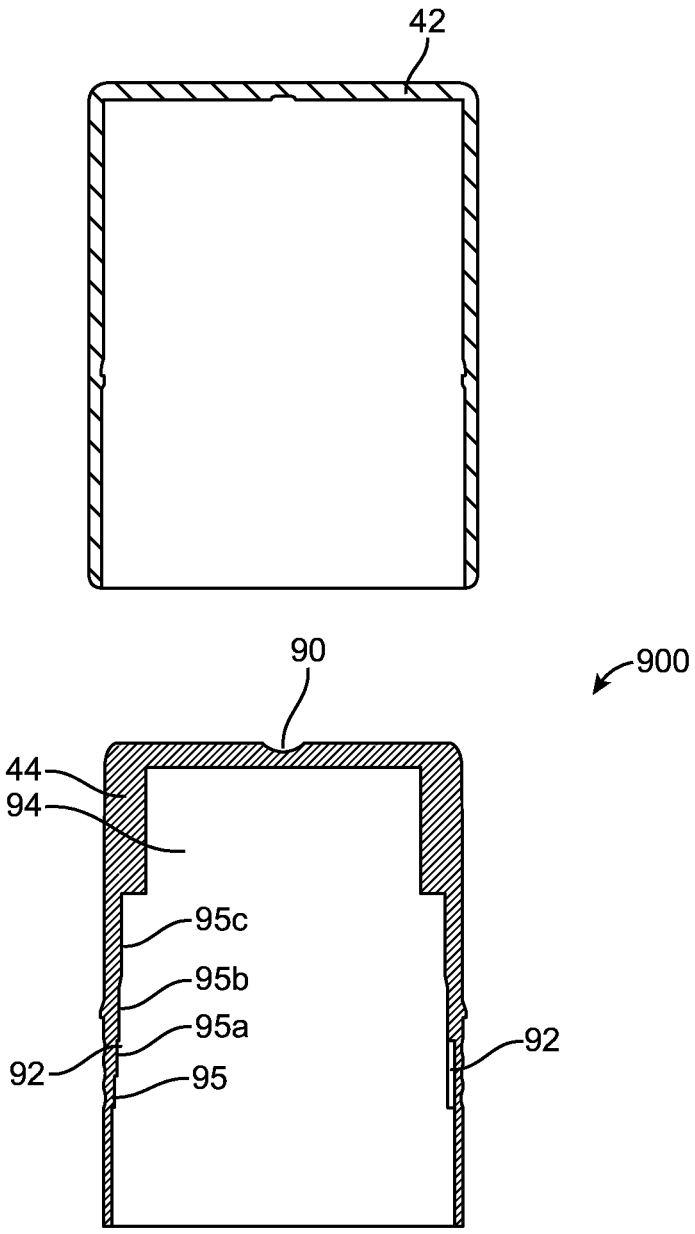
FIG. 10 illustrates an exploded view of an exemplary outer cap of a retractable pencil.

FIG. 10 illustrates an exploded view of the outer cap 42 and sleeve 44. In this example, the sleeve 44 has an injection gate recess 90 located at the top, through which a cosmetic material can be imparted. As in FIG. 9, the inside 94 of the sleeve 44 is tapered by tapering elements 95-95*c*. It will be understood that while four tapering elements are shown in this example, more or fewer are possible within this disclosure. Again, the sleeve 44 can include a trough 92 or cutaway region to allow air to escape when the outer cap 42 and sleeve 44 are joined to the rest of the pencil 10.

Figure 11:
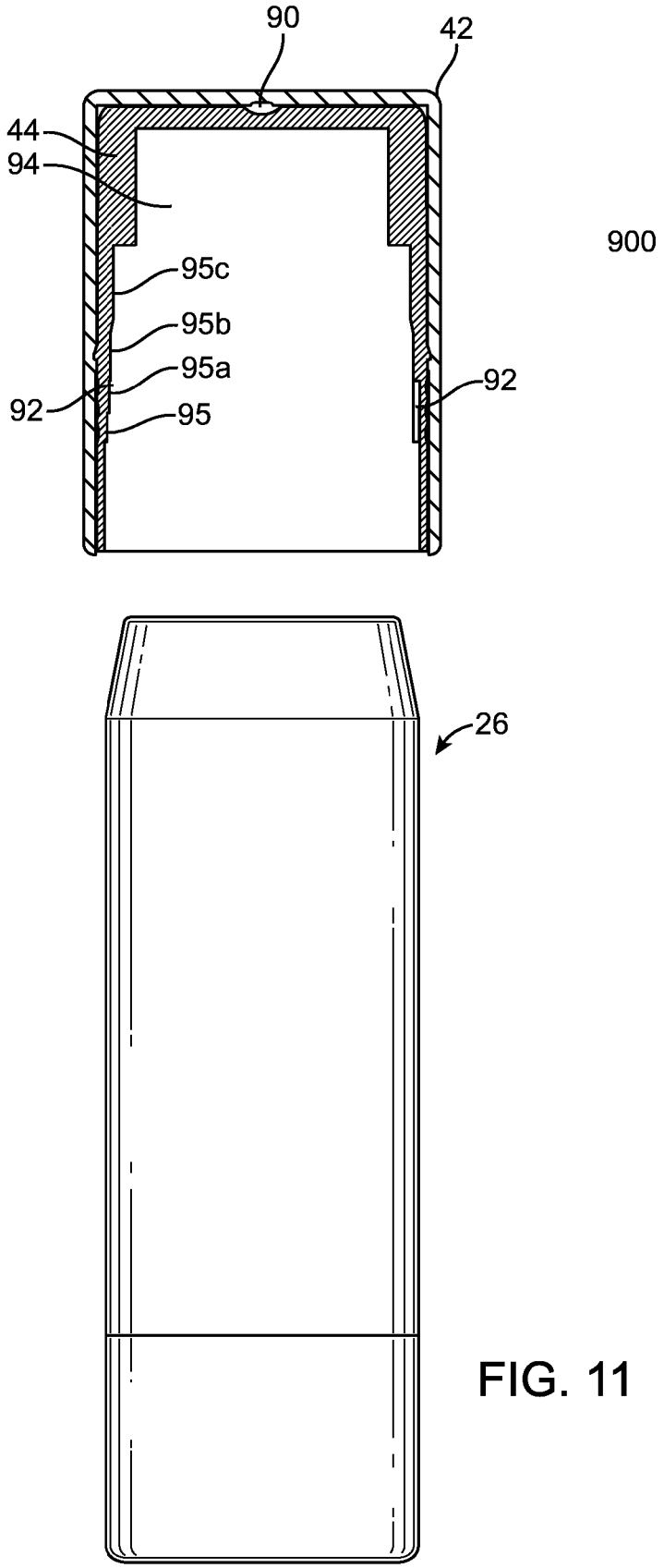
FIG. 11 illustrates an exemplary outer cap of a retractable pencil, in a receiving configuration.

FIG. 11 illustrates the outer cap 42 in a receiving configuration 900 in which the outer cap 42 is arranged to insertably receive the barrel 26 of the pencil 10. As shown, corresponding elements of the sleeve 44 and the barrel 26 are suitably configured for the upper portion of the barrel 26 to be coupled to the outer cap 42.

Figure 12:
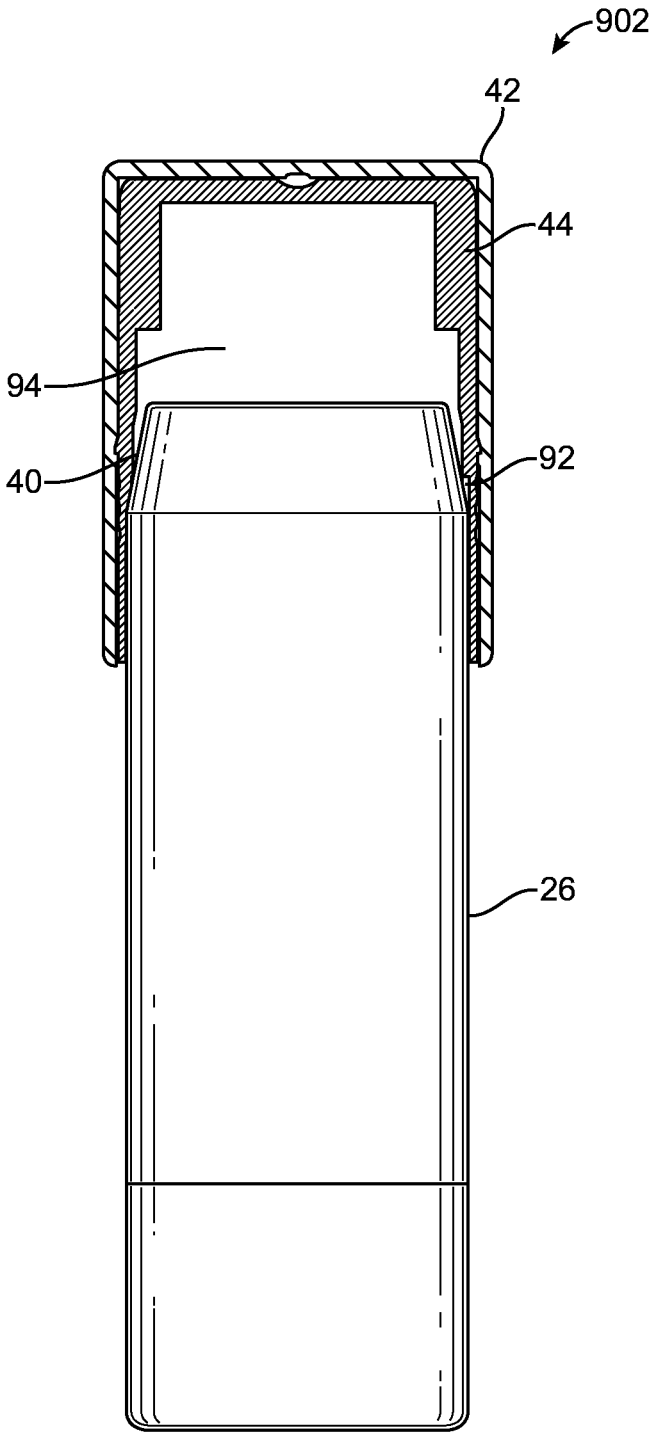
FIG. 12 illustrates an exemplary barrel of a retractable pencil, in a transitioning configuration.
Figure 13:
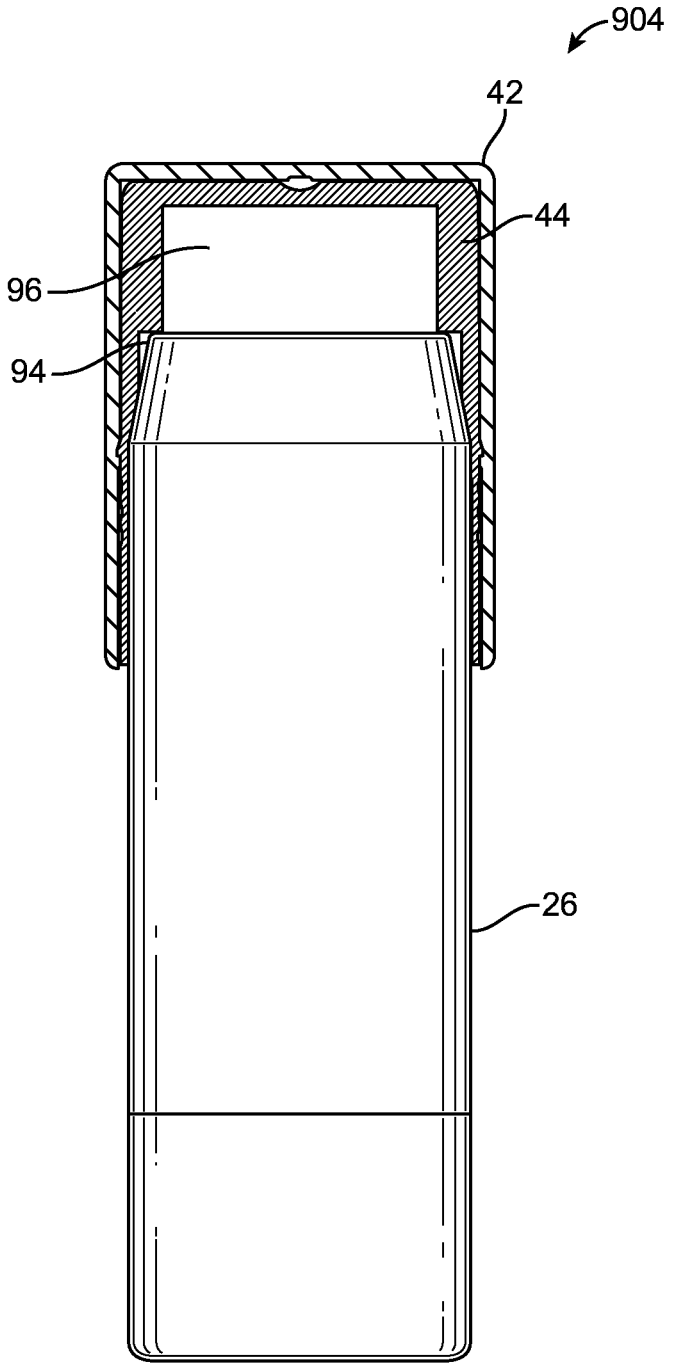
FIG. 13 illustrates an outer cap releasably coupled to the barrel of FIG. 12.

FIG. 12 illustrates the barrel 26 in a transitioning configuration 902 in which it transitions from the receiving configuration 900 to a coupled configuration (see FIG. 13). As discussed above, troughs such as 92 allow air to escape as the barrel 26 is received within the outer cap 42.

FIG. 13 illustrates the outer cap 42 in a coupled configuration 904, in which it is releasably coupled to the barrel 26. The inside receiving space 94 of the sleeve 44 is substantially filled by the barrel 26, however space 96 remains available to receive and protect a cosmetic product 46 therein which can protrude from the barrel 26.

While the present disclosure has been described in relation to a retractable cosmetic pencil that can be back filled or top filled, the present disclosure can work with a variety of different filling techniques and types of cosmetics. The present disclosure can work with both solid and gel like cosmetics. Additionally, the cosmetic product can be premolded and inserted, hot poured, and back filled.

Additionally, while the present illustration of the embodiments of the retractable cosmetic pencil is substantially cylindrical, other embodiments are considered within the scope of this disclosure. The embodiments described herein are illustrative of this disclosure, and are not intended to limit the scope of the following claims.

What is claimed is:

1. A retractable pencil comprising:

a) an end cap;

b) an activation member coupled to the end cap and forming a through-hole substantially along an axis of the activation member, wherein the through-hole has an inside that is at least partially threaded;

c) a godet having an exterior that is at least partially threaded and configured to be coupled to the at least partially threaded inside of the activation member; a barrel coupled to the activation member;

d) a first o-ring configured to be coupled to the activation member and abutted to the endcap, thereby providing a seal between the end cap and the activation member;

e) a second o-ring configured to be coupled to the activation member and abutting the barrel, thereby providing a seal between the barrel and the activation member, wherein the end cap and the barrel meet at a perimeter.

2. The retractable pencil of claim 1, wherein the activation member and godet can be assembled together and respectively receive a product through an open end formed in both of the godet and the activation member, thereby providing for a back filling of the product.

3. The retractable pencil of claim 1, further configured to have an extended orientation in which the godet is wound outward so that it has an outermost end that is substantially flush with an outer most end of the barrel.

4. The retractable pencil of claim 3, wherein the godet forms an opening in the end that is substantially flush with the outermost end of the barrel and the opening being configured to receive a product therethough.

5. The retractable pencil of claim 1, further comprising an outer cap configured to be coupled to the barrel.

6. The retractable pencil of claim 5, further comprising a sealing member located within the outer cap, wherein the sealing member is configured to provide a seal with the barrel so as to prevent free exchange of air when the outer cap is coupled to the barrel.

7. The retractable pencil of claim 6, wherein the godet forms an opening formed in an open end closest to an end of the activation member that is received in the end cap.

8. The retractable pencil of claim 7, wherein the activation member and the godet can be assembled together and the godet is configured to receive a product through the open end, thereby providing for a back filling of the product.

9. The retractable pencil of claim 8, wherein the end cap only has a single opening formed in one end, the single opening configured to receive the activation member, thereby providing an effective sealing of the product from the bottom.

10. The retractable pencil of claim 5, wherein the outer cap includes a sleeve.

11. The retractable pencil of claim 10, wherein the sleeve includes at least one tapering element which seals the sleeve around the barrel when the outer cap is coupled to the barrel.

12. The retractable pencil of claim 11, wherein an inner portion of the sleeve includes at least one trough through which air can pass when the barrel is transitioned to a coupled configuration within the outer cap.

13. A retractable pencil comprising:

a) an end cap;

b) an activation member coupled to the end cap and forming a through-hole substantially along an axis of the activation member, wherein the through-hole has an inside that is at least partially threaded;

c) a godet having an exterior that is at least partially threaded and configured to be coupled to the at least partially threaded inside of the activation member; a barrel coupled to the activation member;

d) a first o-ring configured be coupled to the activation member and abutted to the endcap, thereby providing a seal between the end cap and the activation member;

e) a second o-ring configured to be coupled to the activation member and abutting the barrel, thereby providing a seal between the barrel and the activation member;

f) an outer cap configured to be coupled to the barrel, wherein the outer cap includes a sleeve that comprises at least one tapering element which seals the sleeve around the barrel when the outer cap is coupled to the barrel.

14. The retractable pencil of claim 13, wherein an inner portion of the sleeve includes at least one trough through which air can pass when the barrel is transitioned to a coupled configuration within the outer cap.

* * * * *